US005135262A

United States Patent [19]

Smith et al.

[11] Patent Number: 5,135,262

[45] Date of Patent: Aug. 4, 1992

[54] METHOD OF MAKING COLOR CHANGE DEVICES ACTIVATABLE BY BENDING AND PRODUCT THEREOF

[75] Inventors: Gary J. Smith, Glenburnie; Robert A. Innes, Kingston, both of Canada

[73] Assignee: Alcan International Limited, Montreal, Canada

[21] Appl. No.: 540,937

[22] Filed: Jun. 20, 1990

[51] Int. Cl.[5] ..... C23C 28/00; C25D 11/26; B65D 55/02

[52] U.S. Cl. ..... 283/94; 205/152; 205/199; 205/200; 205/322; 283/81; 283/95; 428/915; 428/916

[58] Field of Search ..... 204/15, 37.6, 38.3, 204/56.1, 58; 428/915, 916; 205/200, 201, 199, 322, 152, 121; 283/94, 95, 81

[56] References Cited

U.S. PATENT DOCUMENTS

| | | | |
|---|---|---|---|
| 3,896,965 | 7/1975 | Cornell | 220/359 |
| 4,763,931 | 8/1988 | Matsuguchi et al. | 283/108 |
| 4,837,061 | 6/1989 | Smits et al. | 428/40 |
| 4,890,763 | 1/1990 | Curiel | 220/455 |
| 5,020,831 | 6/1991 | Benardelli | 283/108 |

FOREIGN PATENT DOCUMENTS

| | | |
|---|---|---|
| 0303400 | 2/1989 | European Pat. Off. . |
| 0381511 | 8/1990 | European Pat. Off. . |

OTHER PUBLICATIONS

World Patents Index Latest, Accession No. 84-162105, week 26, Derwent Publications Ltd., London GB; and JP-A-59 087 149 (Mitsubishi Chem. Ind. K.K.), May 19, 1984.

*Primary Examiner*—John Niebling
*Assistant Examiner*—William T. Leader
*Attorney, Agent, or Firm*—Cooper & Dunham

[57] ABSTRACT

Color change devices which are capable of undergoing a color change on bending. The devices comprise a flexible substrate having a color generating metal (e.g. a valve metal such as Ta or Nb) at at least one surface and an intimately contacting optically thin anodic film covering the color generating metal and generating a visible color by light interference and absorption effects. The thin anodic film is produced by anodizing the color generating metal in the presence of an adhesion-reducing agent (e.g. a fluoride) for weakening the normally tenacious bond between the anodic film and the metal. Devices of this kind capable of being activated by bending, as well as by separation of the constituent layers, are produced by carrying out the anodization step in the presence of a particular concentration of the adhesion reducing agent from a narrow range (e.g. 40–350 ppm of fluoride). The devices can be used as tamper evident labels and the like which show evidence of removal of the labels from articles to which they are originally attached as an indication of tampering.

15 Claims, 1 Drawing Sheet

METHOD OF MAKING COLOR CHANGE DEVICES ACTIVATABLE BY BENDING AND PRODUCT THEREOF

BACKGROUND OF THE INVENTION

1. FIELD OF THE INVENTION

This invention relates to color change devices, i.e. devices which undergo a change of color when physically disturbed in some way. More particularly, the invention relates to laminated color change devices capable of undergoing a change of color by means other than direct delamination of the constituent layers of the device.

2. DESCRIPTION OF THE PRIOR ART

In our prior U.S. Pat. No. 4,837,061 to Smits et. al. issued on Jun. 6, 1989 (the disclosure of which is incorporated herein by reference), a process for producing color change devices, particularly those used as tamper evident structures, is disclosed. The process involves anodizing a color generating metal, such as a valve metal (e.g. Ta, Nb, Zr, Hf and Ti), a refractory metal (e.g. W, V and Mo), a grey transition metal (e.g. Ni, Fe and Cr), a semi-metal (e.g. Bi) or a semiconductor metal (e.g. Si), in order to form an anodic film of oxide having a thickness in the order of the wavelength of light (referred to as an "optically thin" film) intimately contacting the color generating metal. The resulting laminates exhibit a strong interference color when illuminated with white light because of light interference effects between reflections from the closely spaced metal and oxide surfaces and because of light absorption which takes place at the metal/oxide interface when color generating metals are employed.

The resulting structures can be formed as color change devices if the anodization is carried out in an electrolyte containing an adhesion reducing agent, such as a fluoride, which lowers the normally tenacious adhesion of the oxide film to the metal substrate. This allows the oxide film to be detached from the substrate with consequent destruction or modification of the exhibited color. Re-attachment of the oxide layer does not result in regeneration of the original color, so the color change is essentially irreversible and forms an effective indication of tampering.

The detachment of the anodic film from the metal substrate can be assisted by adhering a transparent or translucent layer to the anodic film and using this layer to reinforce the delicate anodic film so that the film can be reliably detached from the metal substrate in large pieces without disintegrating.

While these prior color change devices have proven to be most effective, they are vulnerable to defeat to some extent when used in certain ways. In particular, when the devices are formed as thin flexible strips or sheets to be adhered to an article to be protected by a layer of adhesive or the like (referred to as tamper-evident labels), it may be possible to remove the entire device from the article without detaching the anodic film from the substrate metal and hence without producing a tell-tale color change. A device removed in this way could be reattached to the original article (e.g. a container that had been opened) or attached to a different (e.g. counterfeit) article. Tamper-evident labels of this kind are extremely useful in practice and it would be a considerable advantage to make them more secure.

OBJECTS OF THE INVENTION

An object of the present invention is to provide thin flexible color change devices which are capable of undergoing a color change when an attempt is made to remove such devices from articles to which they are attached.

Another object of the present invention is to provide self-voiding tamper-evident labels which undergo a color change when subjected to bending.

Yet another object of the invention is to provide a process for producing such devices and labels.

SUMMARY OF THE INVENTION

According to one aspect of the present invention, there is provided a process for producing a color change device capable of undergoing a change of color upon bending of the device, said process comprising providing a flexible substrate having a color-generating metal at a first surface of the substrate; and anodizing said color-generating metal at a voltage sufficient to form an anodic film on said substrate having a thickness suitable for generating a color; wherein said anodizing step is carried out in the presence of an adhesion-reducing agent for said anodic film having a concentration which results, at said anodizing voltage, in the formation of said anodic film in such a way that said generated color is changed when said substrate and attached anodic film undergo bending.

According to another aspect of the invention, there is provided a color change device, comprising a flexible substrate comprising a color generating metal at a first surface; and an optically thin anodic film on said color generating metal intimately contacting said first surface of said substrate and generating an interference color; said device having at least one area in which said interference color can be changed by bending said flexible substrate.

By the term "color-generating metal" as used herein, we mean a metal capable of generating a color different from its normal color when covered by an intimately contacting optically thin layer of transparent material, i.e. a layer having a thickness in the order of the wavelength of light suitable to generate optical interference effects.

The devices of the invention are considerably less vulnerable to defeat when used as tamper-evident labels because the bending which almost inevitably takes place when attempts are made to remove the devices from articles to which they are adhered causes the devices to change color and thus to indicate that tampering has taken place.

The devices of the present invention preferably have a layer of transparent or translucent material adhering to the anodic film in order to protect the delicate film from damage by scratching, etc. and to assist the color change effect which takes place upon bending of the device. The transparent or translucent material is preferably a plastic or polymer sheet attached to the anodic film by means of an adhesive or by other means such as heat sealing. In some cases the sheet may be made friable so that it disintegrates when bending takes place and provides further evidence of tampering.

The devices of the invention also normally have a layer of adhesive on the surface opposite to the color generating surface so that the devices may be attached to articles to be protected. This is not always essential, however, since the object to be protected may in some cases itself be adhesive or the user of the device may apply an adhesive at the time of application of the device to the article to be protected.

The ability of the devices of the invention to be activated by bending is unexpected because it would not normally be anticipated that anodic films thin enough to generate optical interference colors would detach from the substrate metal under the minimal forces exerted upon bending (the ratio of forces produced by bending is very low when the cross sectional area versus the adhesive strength is taken into account). For example, printing ink does not separate from paper upon bending, even though such ink is about five times thicker than the anodic films employed in the present invention. Moreover, other types of peelable layers adhering to bendable substrates, such as common adhesive tape on thin aluminum foil, do not become detached upon bending. The present invention therefore represents an unpredictable improvement of the type of devices disclosed in our prior patent.

DETAILED DESCRIPTION OF THE PREFERRED EMBODIMENTS

Figure 1:
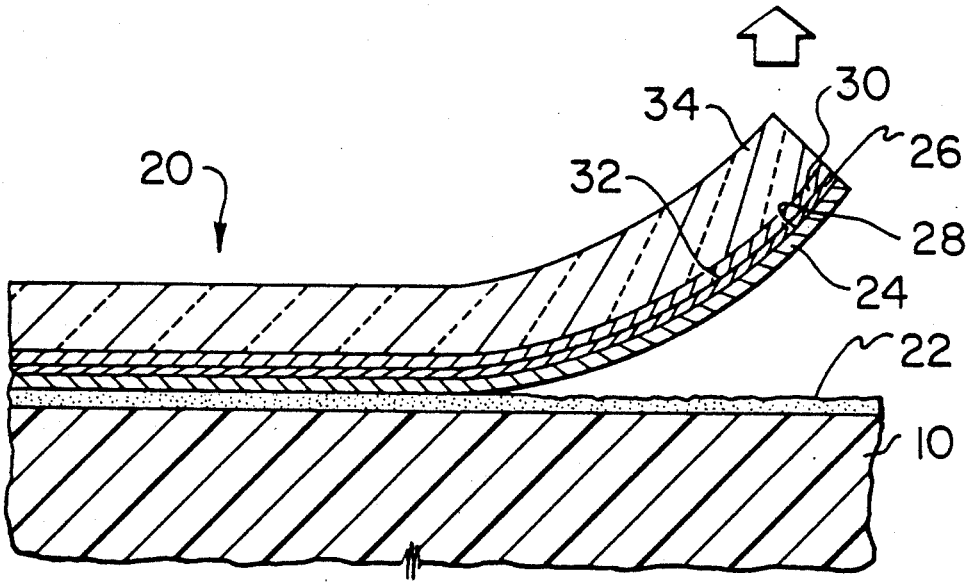
FIG. 1 is a cross-section of a thin, flexible label according to one form of the present invention attached to an article to be protected.

The present invention provides flexible color change devices of the type described in our U.S. patent mentioned above which undergo changes of color when the devices are bent or flexed rather than requiring deliberate separation of the anodic film from the metal substrate, e.g. by peeling or puncturing. It has been found that such devices can be produced in essentially the same way using essentially the same color-generating metals as the devices of our prior patent, except for varying certain parameters, particularly the concentration of the adhesion-reducing agent present during the anodization step.

We have unexpectedly found that only the use of concentrations of adhesion-reducing agents from narrowly defined ranges during the anodization step leads to devices which can be activated by bending according to the present invention. The effective concentrations depend not only on the nature of the adhesion-reducing agent and the color-generating metal, but also to some extent on the thickness of the anodic film which is, in turn, governed by the anodization voltage (and possibly the anodization time). In general, the use of higher anodization voltages for the preparation of the device requires lower concentrations of the adhesion-reducing agent to produce devices of equal susceptability to activation by bending.

Additionally, the triggering of the change of color in the devices of the invention depends not only on the inherent sensitivity of the device to activation by bending, which is governed by the concentration of the adhesion-reducing agent and the voltage used for the formation of the device as indicated above, but also on the radius of curvature through which the device is bent or flexed. Bends involving small radii of curvature of this kind are more likely to cause activation of a device, so devices which tend to bend more easily through small radii of curvature when removed from an underlying object tend to be more sensitive to activation than devices that do not bend so readily, other things being equal. It has been found in practice that activation of the color change normally requires the device to be bent into a curve having a radius of about 0.085 inches or less.

The curvature through which a device bends during attempted detachment of the device from an article it is intended to protect depends on the overall stiffness of the device and its strength of attachment to the article. Devices having thicker or stiffer layers tend to bend less readily and may require the use of higher concentrations of adhesion-reducing agent during their preparation to compensate for this. Devices adhered more firmly to articles to be protected require the use of greater force for their removal and this can cause smaller bending radii (and possibly higher overall bending angles) for devices of any given stiffness. In practice, therefore, devices attached more firmly may be made less sensitive to activation by bending than identical devices attached more loosely.

Consequently, in order to produce effective devices according to the present invention it is often necessary to balance or optimize at least the concentration of the adhesion-reducing agent used for the preparation of the device with the effective range of the anodization voltage (and possibly time), the stiffness of the finished device and the strength of attachment of the device to the article to be protected, so that activation inevitably takes place when tampering is attempted, but not before.

As in our prior patent, the preferred adhesion-reducing agent is a fluorine-containing compounds may be used in the form of aqueous solutions of simple salts, e.g. NaF or KF, complex salts, or acids such as hydrofluoric acid, fluoroboric acid, etc. Our prior patent states in Column 6, line 54 that concentrations of fluoride can be as low as 0.1% by volume of the bath electrolyte (corresponding to 1,000 ppm) when the color-generating metal is Ta. Example 1 of the patent utilizes 0.1 vol % of 49% concentrated HF corresponding to 470 ppm F°, whereas Example 2 utilizes one drop of concentrated hydrofluoric acid in 500 ml which can be calculated as 20 ppm F°. Both these Examples relate to the anodization of Ta. In contrast to this, we have now unexpectedly found that by using concentrations of fluoride falling within the range of 40–350 ppm, devices according to the present invention can be produced from most color-generating metals at the anodization voltages required for color generation (usually 85–150 V). When the concentration falls outside this range, the desired color change is not produced on bending or, particularly in the case of higher concentrations, the anodic film may spall off prematurely leading to an unwanted color change.

In the case of tantalum, the effective concentration of F° is usually in the range of 40–90 ppm in the anodizing electrolyte. When the color generating metal is niobium, a concentration of fluoride in the range of 150–350 ppm produces good color loss activation upon bending.

Incidentally, the concentration of fluoride referred to in this specification is the concentration of the fluoride ion, preferably as measured directly by a fluoride ion electrode.

More exact maxima and minima of the effective fluoride concentrations for tantalum as the color generating metal at various anodization voltages are shown in Table 1 below.

TABLE 1

| ANODIZATION VOLTAGE | Color | ANODIZATION TIME (s) | FLUORIDE CONCENTRATION MAXIMUM (ppm) | FLUORIDE CONCENTRATION MINIMUM (ppm) |
|---|---|---|---|---|
| 85 V | yellow | 10 | 90 | 80 |
| | | 20 | 90 | 70 |
| | | 30 | 80 | 70 |
| 110 V | red | 10 | 80 | 50 |
| | | 20 | 70 | 50 |
| | | 30 | 70 | 50 |
| 120 V | blue | 10 | 80 | 50 |
| | | 20 | 70 | 40 |
| | | 30 | 70 | 40 |
| 140 V | green | 10 | 60 | 40 |
| | | 20 | 60 | 40 |
| | | 30 | 70 | 40 |

In general, it can therefore be stated that for tantalum, a voltage of about 85 V requires fluoride concentrations of about 70–90 ppm, voltages of about 85 to 110 V require concentrations of about 50 to 80 ppm, voltages of about 110 to 120 V require concentrations of about 40–80 ppm, and voltages of about 120 to 140 V require concentrations of about 40–70 ppm.

As noted above, sensitivity to activation depends to some extent on the overall stiffness of the device, which is mainly governed by the thickness of the overlying transparent or translucent layers since the color-generating metal substrate is usually a very flexible thin foil of 10 μm in thickness or less. Tests have shown (see Example 8 below) that good results are achieved when the thickness of any overlying transparent or translucent polymer layer is about 125 μm.

The color generating substrate commonly comprises a very thin (usually sputtered) layer of the color-generating metal on a thin foil of inexpensive metal, such as aluminum. Such a structure makes it possible to minimize the quantity of the expensive color-generating metal required for the fabrication of the device. In some cases, the aluminum foil may itself be supported on a sheet of plastic, in which case the stiffness of this additional plastic sheet should of course be taken into account when estimating the overall stiffness of the device.

A typical device of the above kind having suitable flexibility consists of a metal foil of about 7 μm in thickness supported on an underlayer of polyester sheet of about 50 μm and covered by a second transparent polyester sheet of about 12.5 μm in thickness.

The adhesive used to attach the device to the article to be protected is usually an inexpensive contact adhesive of high adhesive strength to discourage attempts at removal of the device and to produce a small radius of curvature when removal is attempted. In some cases, however, a lower adhesive strength is required, for example if the device is intended to be removed from the article by hand during the legitimate use of the article (e.g. if the device is to form a removable seal for a container). In such cases, it will be appropriate to use devices of higher sensitivity to activation by bending. In general, it can be stated that the adhesive strength should be high enough to produce adequate bending but not higher than the tear strength of the material of the article to be protected.

The devices of the present invention are normally bent during activation into curves having the anodic oxide film on the inside of the curve because the anodic film must generally be outermost for the color to be generated. However, a color change is usually also produced if the device is bent through a curve having the anodic film on the outside, although it is observed that the sensitivity of the device may then be somewhat reduced.

In addition to the basic devices discussed so far, the present invention is capable of producing more complex devices similar to those described in our prior U.S. patent referred to above. In particular, our prior U.S. patent describes color change devices which incorporate "latent indicia", i.e. messages, patterns or designs which are not visible before the color change is produced, but which become visible when the color change is activated. These devices are produced by masking certain areas of the color-generating metal from the effects of the adhesion-reducing agent, at least during the initial stages of the anodization step. As a result, certain parts of the resulting anodic film become activatable while other parts remain substantially incapable of exhibiting a color change, but otherwise the anodic film is identical in all areas of the device. When attempts are made to remove the device from the underlying article, a color change takes place only in certain areas of the device. The resulting areas of contrasting colors form a visible message, pattern or design. When producing devices of this kind, care should be taken to ensure that the concentration of the adhesion-reducing agent is suitable for activation by bending but low enough to prevent premature development of the latent indicia. Suitable concentrations can be found by simple experimentation.

In addition to the procedure for incorporating latent indicia into the color change devices disclosed in our prior patent, which involves a two step anodization procedure, an alternative single step procedure as disclosed in our copending U.S. patent application Ser. No. 07/510,175 filed on Apr. 17, 1990, the disclosure of which is incorporated herein by reference, may also be employed.

When the devices of the present invention do not incorporate latent indicia, bending to activate the color change may in some cases result in complete separation of the anodic film, and the overlying transparent or translucent layer when present, from the underlying structure. When the devices incorporate latent indicia, the anodic film detaches only in those areas of the device which undergo a color change and remains attached in those areas which do not undergo a color change. The anodic film as a whole, particularly if reinforced by an overlying flexible layer of transparent or translucent material, therefore normally remains attached to the underlying structure in devices which incorporate latent indicia.

Incidentally, while it is usual to provide overlying flexible layers of transparent or translucent material in the devices of the present invention, whether or not they contain latent indicia, this is not essential because a color change is observed when devices having no such adhered overlying layers are bent through a suitable angle. However, such layers have the advantages of providing protection for the delicate anodic film prior to activation of the device and also of providing a further element of protection against tampering in that the tell-tale color change is produced if peeling apart of the device is attempted, as well as complete removal of the device from an article to which it adheres. This is because the devices of the present invention remain activatable by peeling or puncturing in exactly the same way as the devices of our prior U.S. patent mentioned above, but have the additional advantage of being activatable by bending.

Color change devices according to the present invention can present a variety of articles in a variety of ways. For example, the devices may be used as seals to prevent unauthorized opening of a container or to prevent an item such as a price tag from being removed from one article and attached to another article of higher value. If desired, devices of this type can also be used for the same type of security applications as the color change devices of our prior patent, i.e. as separable structures, but they have the additional advantage that the security feature cannot be circumvented by removing the entire device from an article it is intended to protect.

Figure 2:
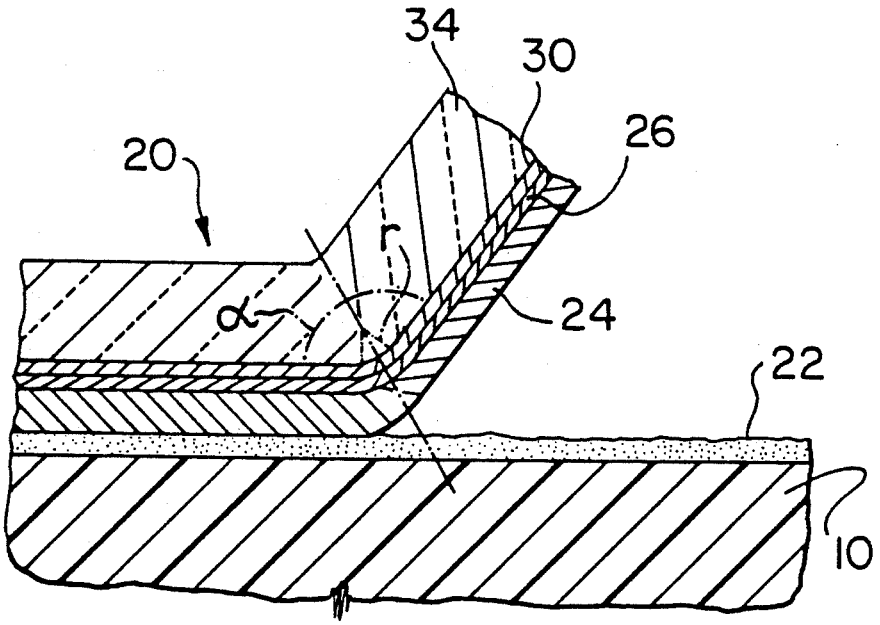
FIG. 2 is a cross-section similar to FIG. 1 but showing the area of the bend, at which color activation takes place, on a slightly larger scale.

A particular embodiment of a device in accordance with the present invention is illustrated in FIGS. 1 and 2 of the accompanying drawings which show an article 10 to be protected against tampering having a thin flexible label 20 according to the invention attached to its surface by an adhesive layer 22. The label 20 consists of a flexible aluminum foil 24 having a thin layer 26 of a color generating metal coating one surface 28 of the foil. The layer 26 of color generating metal has an intimately associated anodic film 30 covering the outer surface 32 thereof formed by anodization in the presence of an adhesion-reducing agent at a concentration suitable for activation of the color change by bending. The entire label 20 is covered by a layer 34 of transparent or translucent material, such as a polymer sheet (preferably heat-sealed to the anodic film 30). As the entire label 20 is peeled from the article from one edge as shown by the arrow in FIG. 1, the inevitable bending causes the originally generated color to be destroyed. If desired, the device may contain latent indicia as indicated above.

FIG. 2 shows the device 20 on a larger scale in the region where it separates from the article 10. As the device separates from the article, its overall thickness and stiffness usually prevents it from forming a completely sharp angle, but instead it is bent around a short radius of curvature r at the apex of included angle $\alpha$. The concentration of adhesion-reducing agent used in the formation of the device is sufficient to permit color change activation when r and $\alpha$ are in the range inevitably encountered when peeling of the entire device from the article 10 is attempted.

Labels of this kind are therefore useful as tamper evident devices because the destruction of the original color and the appearance of the latent indicia (if any) can be used to indicate that either an attempt has been made to remove the label from the original article or that the label has been removed from the original article and attached to another, e.g. a counterfeit.

Uses for the labels include such things as the protection of cigarette boxes, asset tags, bottle caps, automotive parts (numbers, bar codes, etc.).

The invention is illustrated further by the following non-limiting Examples.

EXAMPLE 1

Samples of niobium supported on aluminum foil were anodized (without masking) in electrolytes containing 150, 175 and 200 ppm of fluoride and at various voltages. The resulting samples were subjected to bending with the following results.

150 ppm—activates (i.e. generates color on bending) only at 150 V 175 ppm—activates starting at 120 V to 150 V 200 ppm—activates starting at 100 V to 150 V.

These results show that fluoride levels of at least 150 ppm are required to produce useful devices in the range of useful colors produced by normal voltages of 100 V to 150 V.

EXAMPLE 2

In this Example, a device containing a latent message was prepared by a single step anodizing process. Tantalum coated foil was printed with messages (VOID) using an uncured flexographic ink and was then anodized for 20 seconds at 110 V in a citric acid electrolyte containing a fluoride concentration of 65 ppm. After washing to remove the ink the sample was laminated with a 12.5$\mu$ transparent polyester film coated with a pressure-sensitive adhesive on top and an acrylic transfer adhesive on the bottom. The resulting product exhibited a wine color and showed no evidence of the latent message prior to activation but, upon bending, exhibited a color change in non-message areas (loss of the wine color in favour of a metallic grey) which made the messages (the areas still displaying a wine color) visible.

EXAMPLE 3

A circular label having a diameter of 30 mm used for sealing cardboard boxes was prepared in the following manner. Tantalum coated foil was printed with an "OPEN" message by means of silk screening and was then anodized for 20 seconds at 85 V in a citric acid electrolyte containing a fluoride concentration of 80 ppm. After washing, to remove the ink, a message stating "ALCAN SEAL" was screened in blue on the surface surrounding the hidden message. Then the label was laminated with the same overlayer and adhesive as in Example 2. The resulting label exhibited a visible blue message "ALCAN SEAL" on a yellow background prior to activation but, upon bending, exhibited a color change in the non-message areas (loss of the yellow color in favour of a metallic grey) which made the "OPEN" message (the areas still displaying a yellow color) also visible.

EXAMPLE 4

A rectangular label of size 35 mm by 50 mm was prepared in the following manner. Tantalum coated foil was printed with several small "VOID" messages by silk screening. Next it was anodized for 20 seconds at 110 V in a citric acid electrolyte containing 60 ppm fluoride. After removal of the ink by washing with water, a message illustrating an Alcan logo and stating "Genuine Part No. BX 2539 Void Upon Removal" was screened in blue on the surface. Next the label was laminated with the same overlayer and adhesive materials as used in Example 2. The resulting label exhibited a visible blue message of the Alcan logo and "Genuine Part No., etc.," on a wine background prior to activation, but, upon bending, exhibited a color change in the non-message areas (loss of wine color in favour of a metallic grey) which made the "VOID" messages (the areas still showing a wine color) also visible.

EXAMPLE 5

A label with a friable coating was prepared in the following manner. Tantalum coated foil was printed with "VOID" messages by silk screening. It was then anodized for 20 seconds at 120 V in a citric acid electrolyte containing a fluoride concentration of 55 ppm. After removal of the ink by washing with water a clear friable organic coating was applied as an overlayer. The coating was basically a melamine cross-linking resin containing an accelerator for curing purposes and some additional solvent. The formula was as follows:

20.0 g Resimene 731 resin
0.35 g Cycat 4045 catalyst
48.0 butyl cellosolve.

The layer was applied with a nylon drawdown bar and cured for 60 seconds at 230° C. Total thickness of the coating was 5 microns. An acrylic transfer adhesive was laminated on the bottom. The resulting product exhibited no evidence of the latent message prior to activation. Upon activation by bending the coating and oxide (on the non-masked areas) disintegrated leaving the blue message areas visible.

After activation, evidence of tampering was obvious due to the tiny iridescent flakes of coating found everywhere.

EXAMPLE 6

A rectangular label of size 5 mm by 25 mm was prepared in the following manner. Tantalum coated foil was printed with a flexographic ink with a "Genuine Product" message and then anodized on a pilot line for 20 seconds at 19 A to a wine color. The electrolyte was citric acid containing 65 ppm fluoride. After anodizing and washing, the material was printed with "Special Filter" using a gold colored flexographic ink. The same overlayer and adhesive as used in Example 2 were laminated on top and bottom. The resulting product showed a visible gold "Special Filter" message prior to activation but, upon bending, exhibited a color change in the non-message areas (loss of wine color in favour of a metallic gray) which made the "Genuine Product" message also visible. The label that could be placed on flap cover type cigarette packages to be used as a flap cover seal.

EXAMPLE 7

This Example relates to a bundle wrap label that could be used to seal a carton of cigarettes. It was prepared in the same way as Example 6 with the only difference being size, which was 35 mm by 150 mm.

EXAMPLE 8

1. Bending Tests

A standardized set of samples indicated below was prepared with two levels of sensitivity and various overlayers and then subjected to bending tests.

Substrate—8 micron foil/50 micron plastic laminate
Messages—Flexo printed generic Alcan logo/void
Anodizing—20 seconds at 125 V for a blue color
Fluoride—45 ppm and 70 ppm
Overlayers—12.5, 25, 50, 100 and 125 microns
Underlayer—Avery FasTape 1151 pressure sensitive adhesive

1.1 Test A—Regular Label with the Oxide on the Inside

After adhering the labels to a countertop they were peeled off to simulate an actual test condition. The following rating system was used for evaluating activation:

| OVER-LAYER | Results: LOWER SENSITIVITY (45 ppm) | Results: HIGHER SENSITIVITY (70 ppm) |
|---|---|---|
| 12μ | A | A |
| 25μ | A | A |
| 50μ | B | A |
| 100μ | B | A |
| 125μ | C | B |

A = total
B = partial
C = no activation

1.2 Test B—Around a Radius with the Oxide on the Inside

This test consisted of bending a mounted label, i.e., adhered to a surface, over a radius with the oxide on the inside of the bend.

| OVER-LAYER | Results: 0.125" r | 0.083" r | 0.063" r | 0.042" r | 0.031" r |
|---|---|---|---|---|---|
| LOWER SENSITIVITY (45 ppm) | | | | | |
| 12.5μ | C | C | C | B | A |
| 25.0μ | C | C | C | B | B |
| 50.0μ | C | C | C | B | B |
| 100.0μ | C | C | C | B | B |
| 125.0μ | C | C | C | C | C |
| HIGHER SENSITIVITY (70 ppm) | | | | | |
| 12.5μ | C | C | B | A | A |
| 25.0μ | C | C | B | A | A |
| 50.0μ | C | C | B | B | A |
| 100.0μ | C | C | B | B | A |
| 125.0μ | C | C | C | B | A |

1.3 Test C—Around a Radius with the Oxide on the Outside

One part of the label was adhered while the other side was bent over a radius.

| OVER-LAYER | Results: 0.125" r | 0.083" r | 0.063" r | 0.042" r | 0.031" r |
|---|---|---|---|---|---|
| LOWER SENSITIVITY (45 ppm) | | | | | |
| 12.5μ | C | C | C | C | C |
| 25.0μ | C | C | C | C | C |
| 50.0μ | C | C | C | C | C |
| 100.0μ | C | C | C | C | C |
| 125.0μ | C | C | C | C | C |
| HIGHER SENSITIVITY (70 ppm) | | | | | |
| 12.5μ | C | B | B | A | A |
| 25.0μ | C | B | B | B | A |
| 50.0μ | C | C | C | B | A |
| 100.0μ | C | C | C | B | A |
| 125.0μ | C | C | C | C | C |

The bend test results show that:

Bending with the oxide on the outside is less sensitive than if it is on the inside especially with a fluoride level close to the bottom limit of the operating range.

Color change activation decreases with increasing overlayer thickness.

What we claim is:

1. A process for producing a peelable label capable of undergoing a change of color upon bending, said process comprising:

providing a flexible substrate having a color-generating metal at a first surface of the substrate;

anodizing said color-generating metal at a voltage sufficient to form an anodic film on said substrate having a thickness which results in the generation of a color by optical interference;

attaching a flexible layer of transparent or translucent material to an outer surface of said anodic film; and applying a layer of peelable adhesive to a second surface of said substrate opposite to said first surface;

wherein said anodizing step is carried out in the presence of 40–350 ppm of a fluoride as an adhesion-reducing agent for said anodic film having a concentration which results, at said anodizing voltage, in the formation of said anodic film in such a way that said generated color is changed when said substrate and attached anodic film undergo bending.

2. A process according to claim 1 wherein said color-generating metal is selected from the group consisting of tantalum and niobium.

3. A process according to claim 1 wherein said color-generating metal is tantalum and said fluoride is present in an electrolyte used for said anodizing step at a concentration in the range of 40–90 ppm.

4. A process according to claim 1 wherein said color-generating metal is niobium and said fluoride is present in an electrolyte used for said anodizing step at a concentration in the range of 150–350 ppm.

5. A process according to claim 1 wherein said anodizing step is carried out at voltage in the range of 85–150 volts.

6. A process according to claim 1 wherein said layer of transparent or translucent material is a polymer sheet having a thickness of 125 μm or less.

7. A process according to claim 1 said layer of transparent or translucent material is friable.

8. A process according to claim 1 wherein said adhesive is a contact adhesive.

9. A process according to claim 1 wherein said adhesive has an adhesive strength sufficiently high to result in said substrate and said anodic film being bent into a curve having a radius of curvature of 0.085 inches or less when said device is adhered to an article with said adhesive and then peeled off said article.

10. A process according to claim 1 wherein said concentration of said adhesion-reducing agent is such that said generated color is changed when said substrate and anodic film are bent into a curve having a radius of curvature of 0.085 inches or less.

11. A process according to claim 1 wherein said color-generating metal is tantalum and said adhesion-reducing agent is a fluoride, and wherein said concentration of said fluoride is chosen according to said voltage in accordance with the following ranges:

| anodization voltage (volts) | concentration (ppm) |
|---|---|
| about 85 | 70–90 |
| 85 to 110 | 50–80 |
| 110 to 120 | 40–80 |
| 120 to 140 | 40–70 |

12. A process according to claim 1 wherein said substrate comprises a self-supporting layer of said color-generating metal.

13. A process according to claim 1 wherein said substrate comprises a layer of said color-generating metal supported on a flexible foil of a different metal.

14. A process according to claim 13 wherein said different metal is selected from the group consisting of aluminum and aluminum alloys.

15. A peelable label capable of undergoing a change of color upon bending, produced by a process comprising:

providing a flexible substrate having a color-generating metal at first surface of the substrate;

anodizing said color-generating metal at a voltage sufficient to form an anodic film on said substrate having a thickness which results in the generation of a color by optical interference;

attaching a flexible layer of transparent or translucent material to an outer surface of said anodic film; and applying a layer of peelable adhesive to a second surface of said substrate opposite to said first surface;

wherein said anodizing step is carried out in the presence of 40–350 ppm of a fluoride as an adhesion-reducing agent for said anodic film having a concentration which results, at said anodizing voltage, in the formation of said anodic film in such a way that said generated color is changed when said substrate and attached anodic film undergo bending.

* * * * *